US006216569B1

(12) United States Patent
Hu

(10) Patent No.: US 6,216,569 B1
(45) Date of Patent: Apr. 17, 2001

(54) CABINET TIP OF A SLOTTED SCREWDRIVER WITH IMPROVED ENGAGEMENT WITH A FASTENER SLOT

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 09/375,649

(22) Filed: Aug. 17, 1999

(51) Int. Cl.[7] ..... B25B 13/48
(52) U.S. Cl. ..... 81/436
(58) Field of Search ..... 87/436, 451, 461, 87/441

(56) References Cited

U.S. PATENT DOCUMENTS 1,411,242 * 3/1922 Faust ..... 81/436
1,899,489 * 2/1933 Wickbergh ..... 81/441
2,631,624 * 3/1953 Wright ..... 81/436
3,120,251 * 2/1964 York ..... 81/436
3,897,812 * 8/1975 Arnn ..... 81/436
3,923,088 * 12/1975 Arnn ..... 81/436
4,105,056 * 8/1978 Arnn ..... 81/436
4,625,598 * 12/1986 Wolfram ..... 81/436
4,873,900 * 10/1989 Ciumaga ..... 81/436
4,878,406 * 11/1989 Simpson et al. ..... 81/436
4,955,936 * 9/1990 Douglas ..... 81/441
5,317,940 * 6/1994 Shun'ko ..... 81/436

* cited by examiner

*Primary Examiner*—Eileen P. Morgan
*Assistant Examiner*—Joni B. Danganan
(74) *Attorney, Agent, or Firm*—Alan Kamrath; Rider, Bennett, Egan & Arundel, LLP

(57) ABSTRACT

A cabinet tip for a screwdriver includes a drive tip end and a neck area below the drive tip end. The neck area includes a bottom wall adapted to engage with a side wall defining a slot of a fastener to be driven when the cabinet tip is in an inclined status relative to the fastener. The drive tip includes two flat or arcuate lateral surfaces. The drive tip end includes an arcuate top face.

3 Claims, 10 Drawing Sheets

CABINET TIP OF A SLOTTED SCREWDRIVER WITH IMPROVED ENGAGEMENT WITH A FASTENER SLOT

BACKGROUND OF THE INVENTION

1. Field of the Invention

The present invention relates to a cabinet tip of a slotted screwdriver having improved engagement with a slot of a fastener.

2. Description of the Related Art

A typical slotted screwdriver includes a cabinet tip for engaging with a slot on a fastener (e.g., a screw). Nevertheless, a slotted screw screwdriver often can only be used for driving a fastener of a certain slot size. If the slot is too large for the cabinet tip, the screwdriver is apt to be disengaged from the fastener. If the user forcibly inerts the cabinet tip into a slot that is too narrow for the cabinet tip, the slot wall will be damaged.

Referring to FIG. 1 of the drawings, in actual use of a slotted screwdriver 70, the slot 161 of the fastener 16 to be tightened or loosened might have an alien object (e.g., a small particle) 60 such that the cabinet tip 71 cannot be in fitting contact with the slot walls. As a result, the driving torque is insufficient and the driving is not smooth. Even if the slot 161 of the fastener 16 has no alien object therein, the user must be cautious to avoid inclination of the screwdriver 70 shown in FIG. 2. More specifically, the cabinet tip 71 tends to disengage from the slot 161 during driving if the side wall 72 of the cabinet tip 71 is not at a right angle with the bottom wall of the slot 161. However, inclination of the screwdriver 70 is inevitable in some cases, e.g., the fastener 16 is located in a place difficult to access and operate.

The present invention is intended to provide an improved slotted screwdriver that mitigates and/or obviates the above problems.

SUMMARY OF THE INVENTION

It is a primary object of the present invention to provide an improved cabinet tip of a slotted screwdriver having improved engagement with a slot of a fastener.

It is another object of the present invention to provide an improved cabinet tip of a slotted screwdriver for driving fasteners of different slot sizes.

A cabinet tip for a screwdriver in accordance with the present invention comprises a drive tip end and a neck area below the drive tip end. The neck area includes a bottom wall adapted to engage with a side wall defining a slot of a fastener to be driven when the cabinet tip is in an inclined status relative to the fastener. The drive tip includes two flat or arcuate lateral surfaces. The drive tip end includes an arcuate top face.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
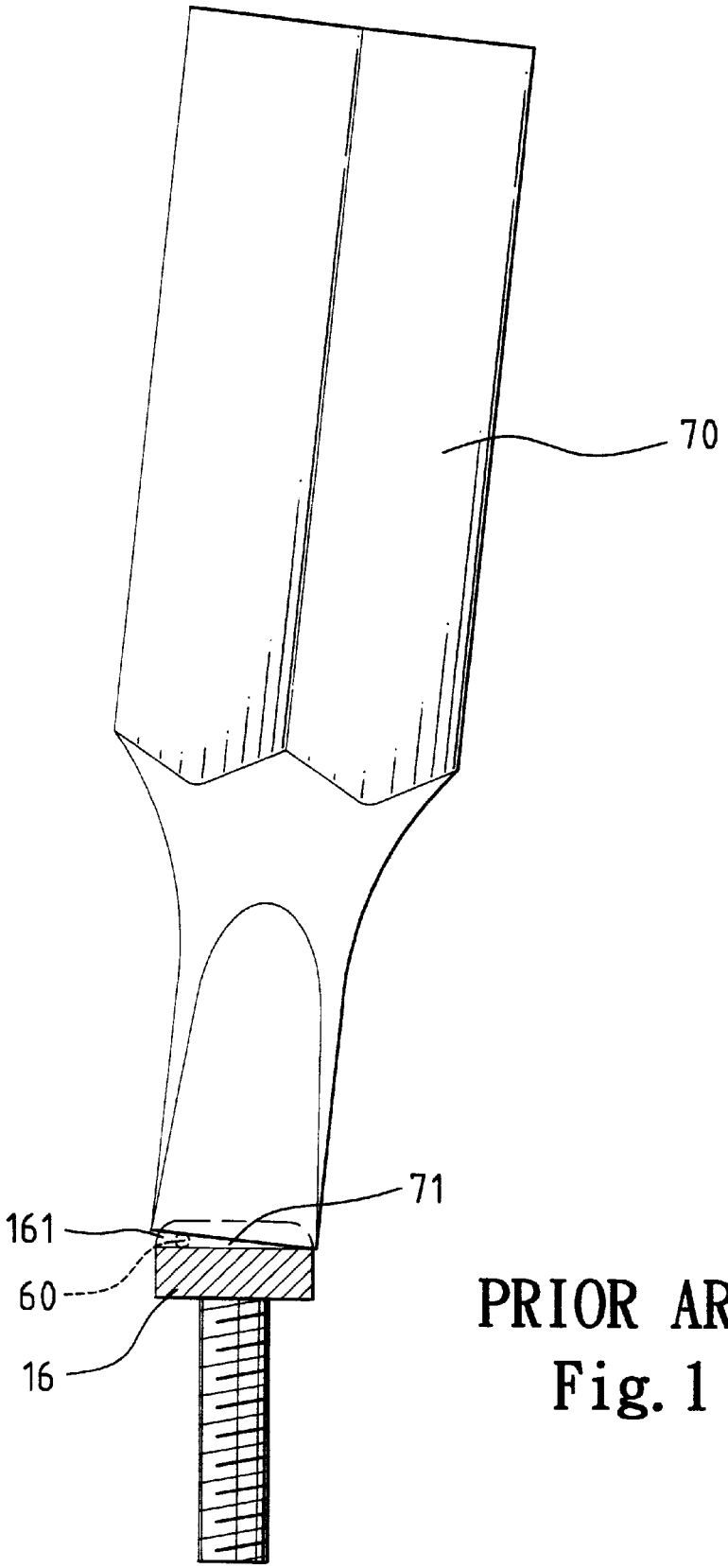
PRIOR ART Fig. 1
FIG. 1 is a side view illustrating a conventional slotted screwdriver for driving a fastener.
Figure 2:
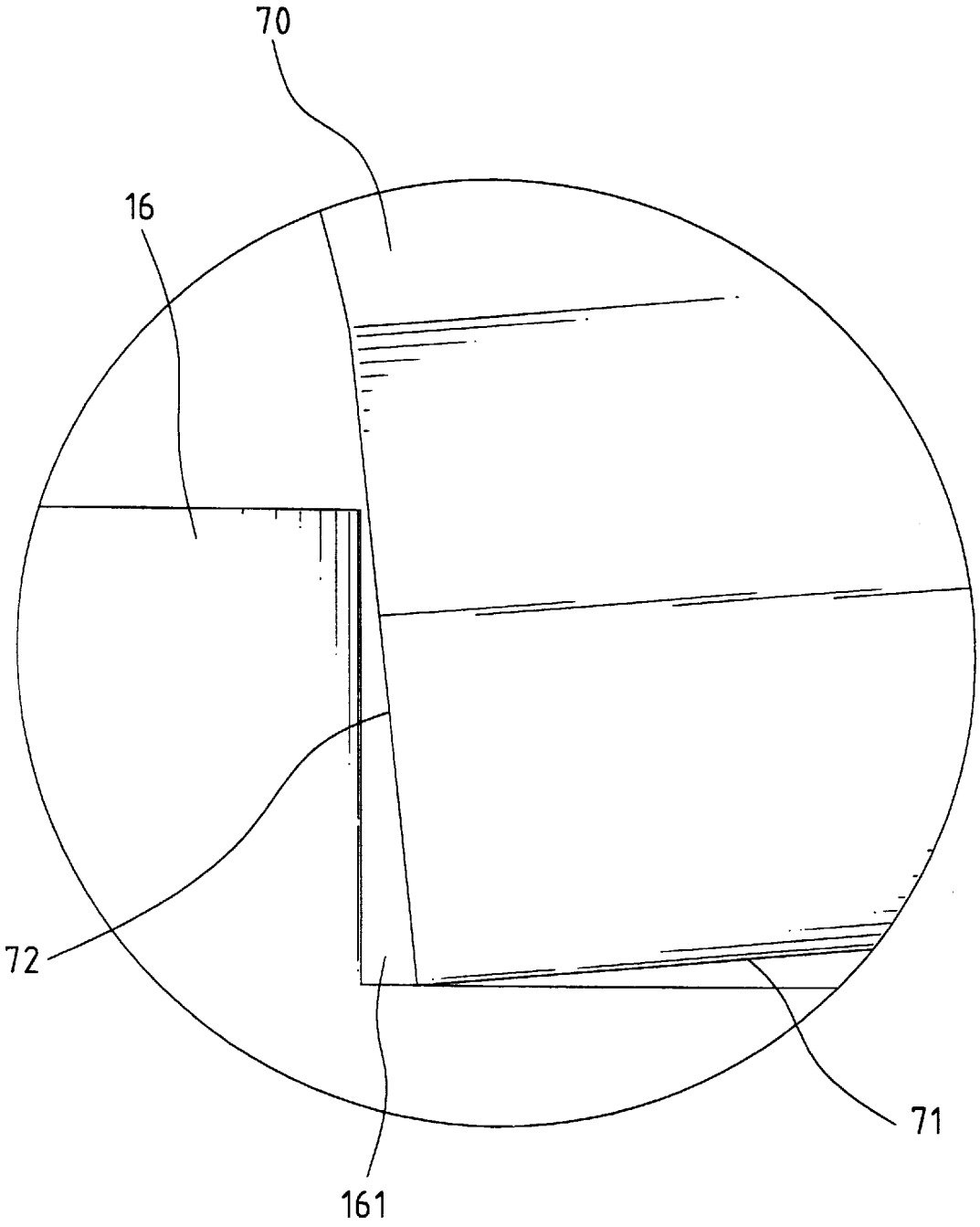
PRIOR ART Fig. 2
FIG. 2 is an enlarged view illustrating engagement between a cabinet tip of a conventional slotted screwdriver with a slot of a fastener.
Figure 3:
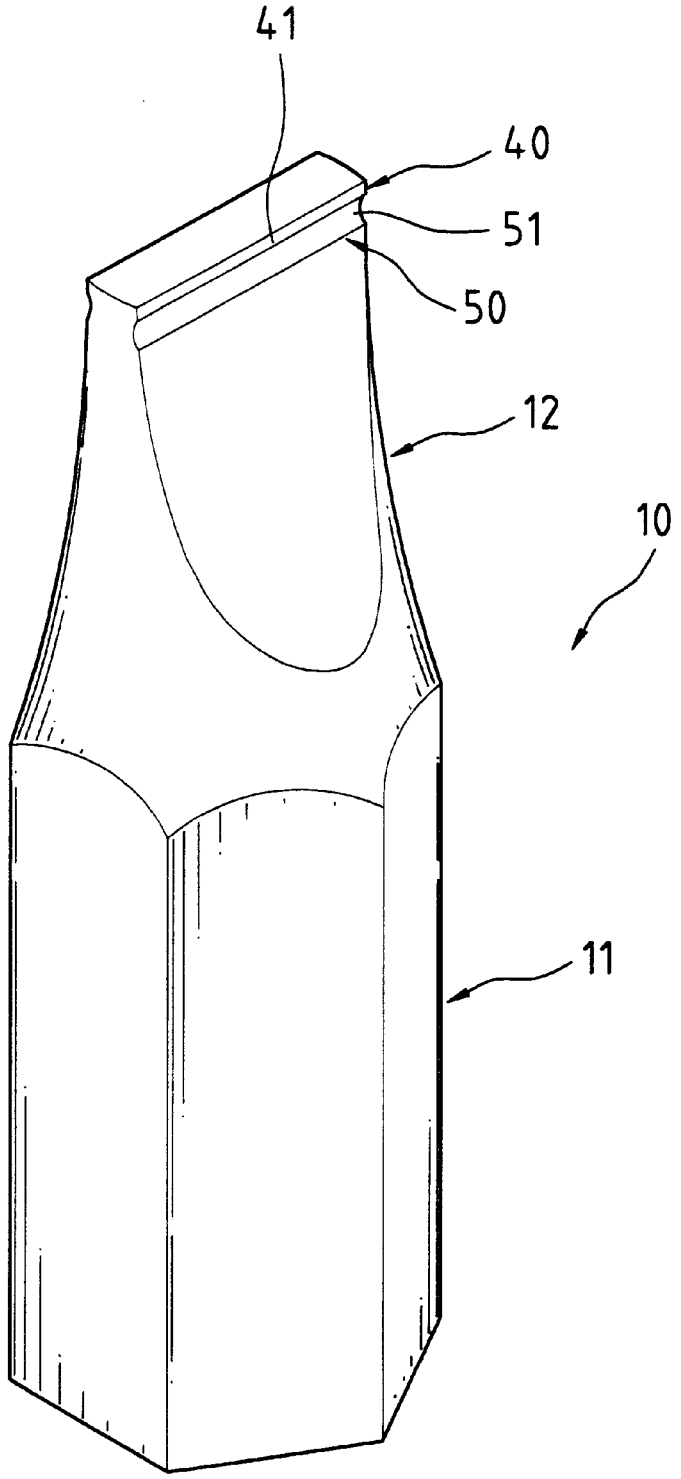
FIG. 3 is a perspective view of a cabinet tip of a screwdriver in accordance with the present invention.

Referring to FIGS. 3 through 9 and initially to FIG. 3, a cabinet tip 12 in accordance with the present invention generally includes a shank 11 connected to a handle (not shown) of a screwdriver 10. The cabinet tip 12 includes a drive tip end 40 having two lateral flat surfaces 41. Below the drive tip end 40, a neck area 50 is formed. In this embodiment, each flat surface 41 has an arcuate groove 51 defined therebelow.

Figure 4:
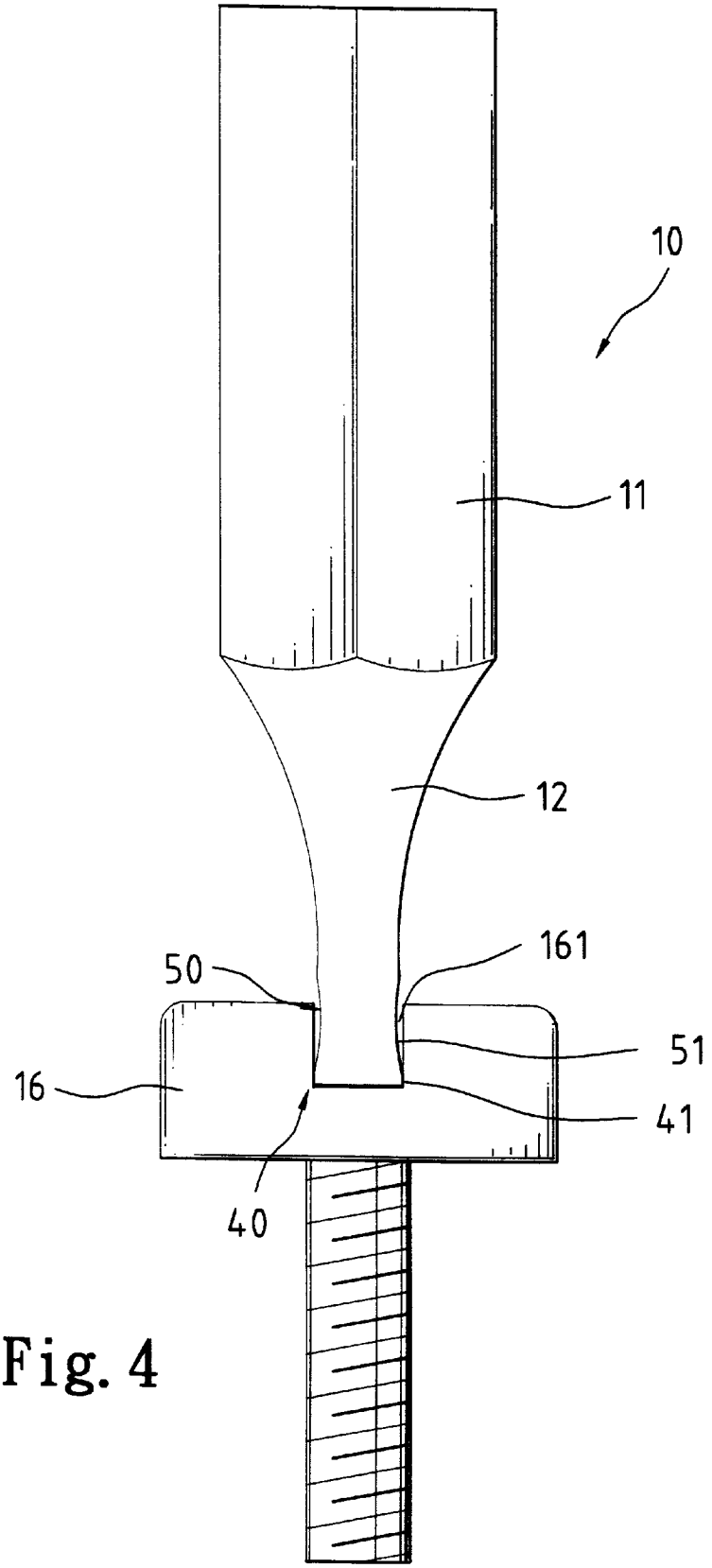
FIG. 4 is a schematic side view of the cabinet tip in accordance with the present invention used to drive a fastener.
Figure 5:
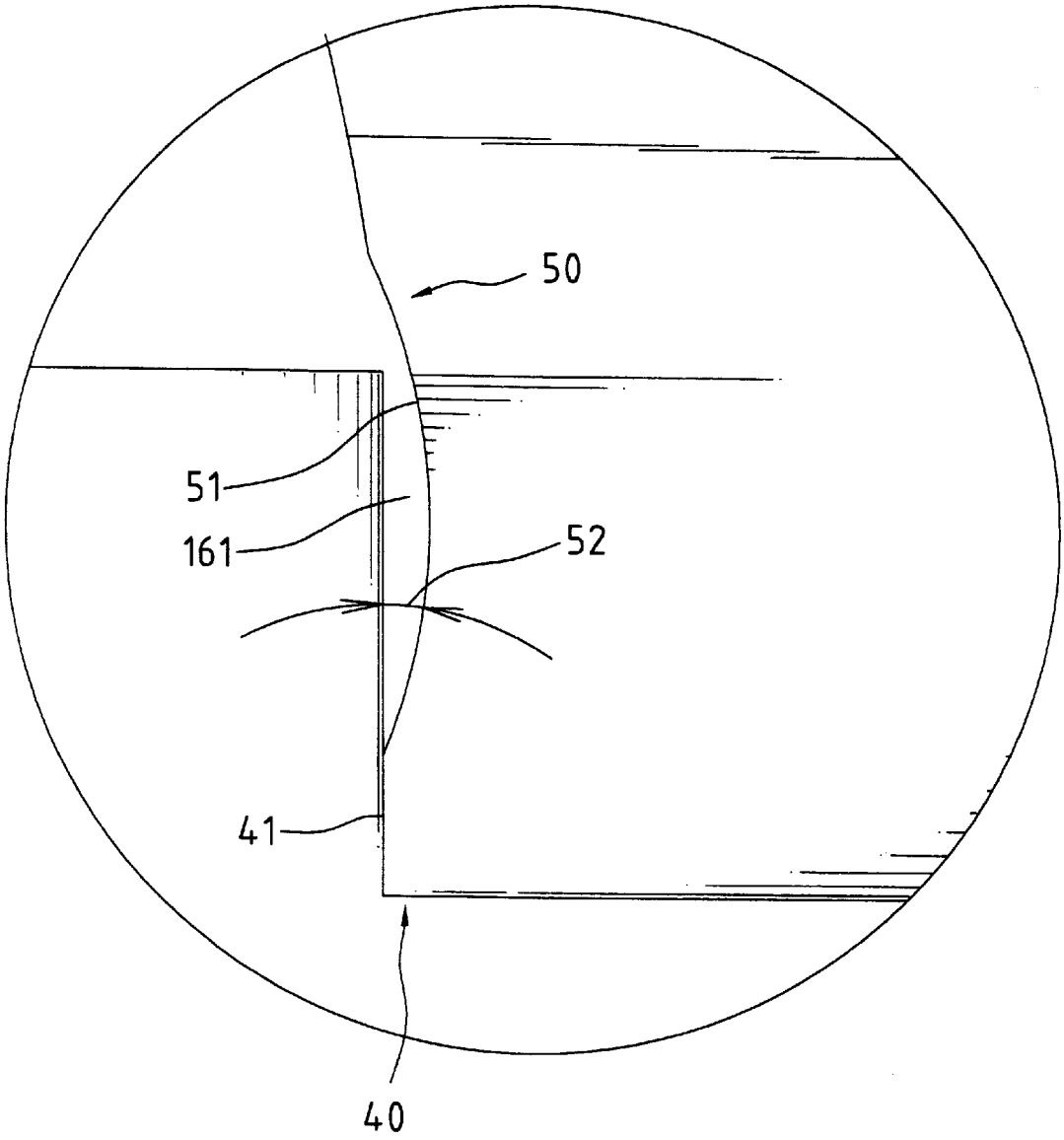
FIG. 5 is an enlarged view illustrating engagement between the cabinet tip in accordance with the present invention and the fastener.
Figure 6:
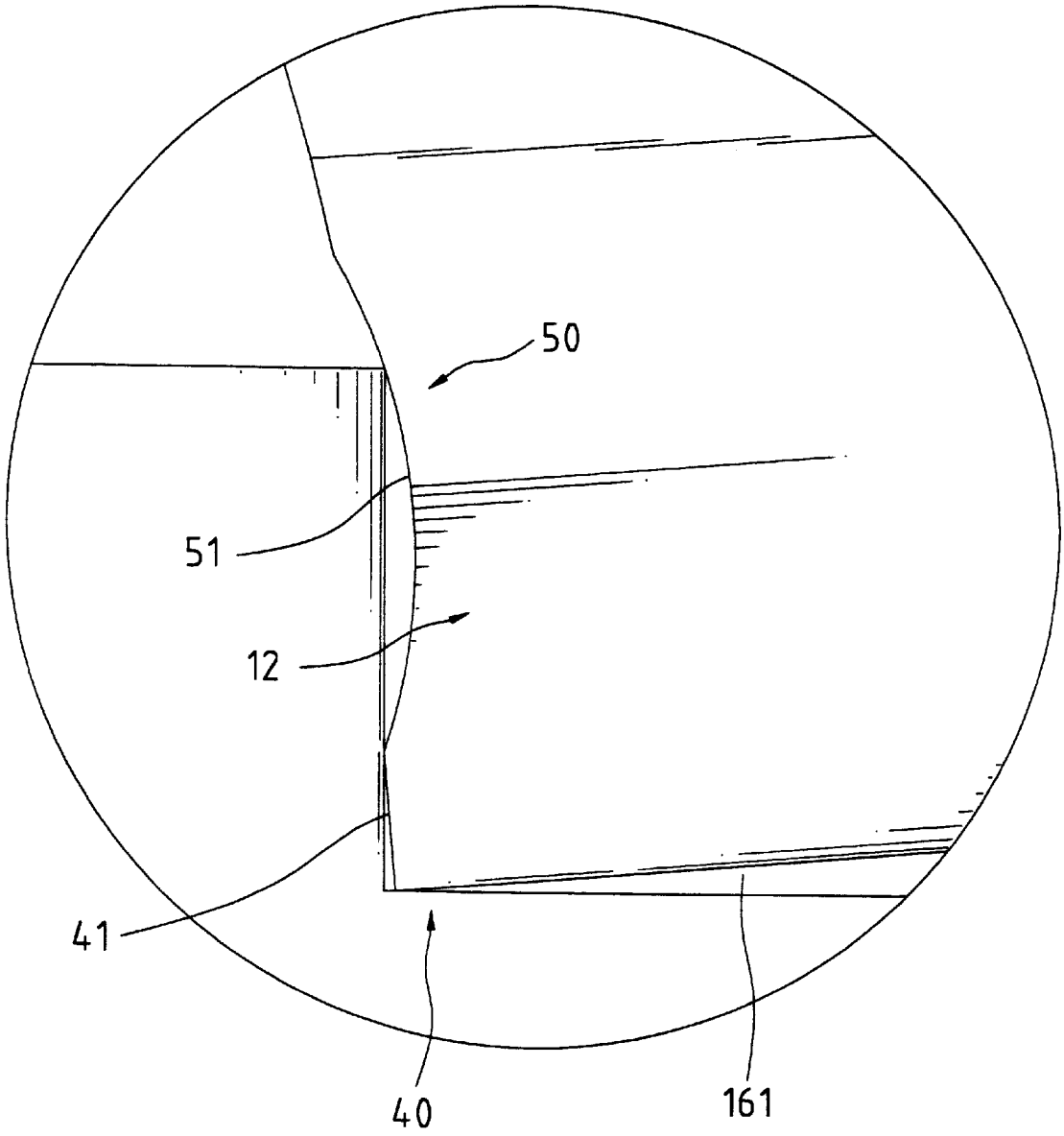
FIG. 6 is an enlarged view similar to FIG. 5, illustrating use of the cabinet tip in an inclined status.

FIG. 4 illustrates use of the screwdriver 10 to a fastener 16 with a slot 161. The flat lateral surfaces 41 of the drive tip end 40 are in fitting contact with the side walls defining the slot 161 of the fastener 16, best shown in FIG. 5. It is appreciated that a gap 52 exists between each side wall of the slot 161 and the neck area 50. When the screwdriver cabinet tip 12 is in an inclined status, the bottom wall defining one of the arcuate grooves 51 bears against an upper edge of one of the side walls of the slot 161, thereby allowing the user to continue driving of the screwdriver, best shown in FIG. 6. Thus, sliding or disengagement of the cabinet tip 12 is prevented.

Figure 7:
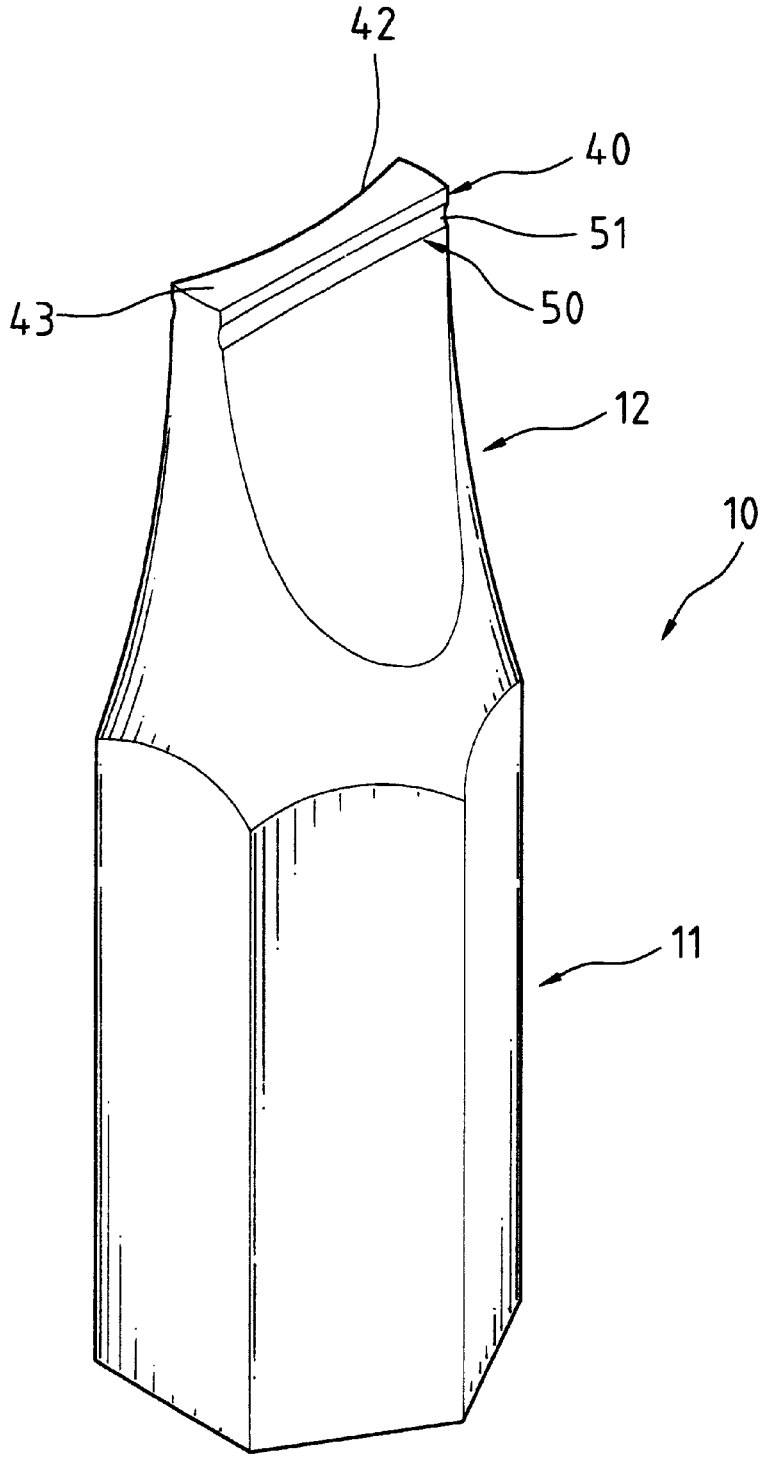
FIG. 7 is a perspective view of another embodiment of the cabinet tip of a screwdriver in accordance with the present invention.
Figure 8:
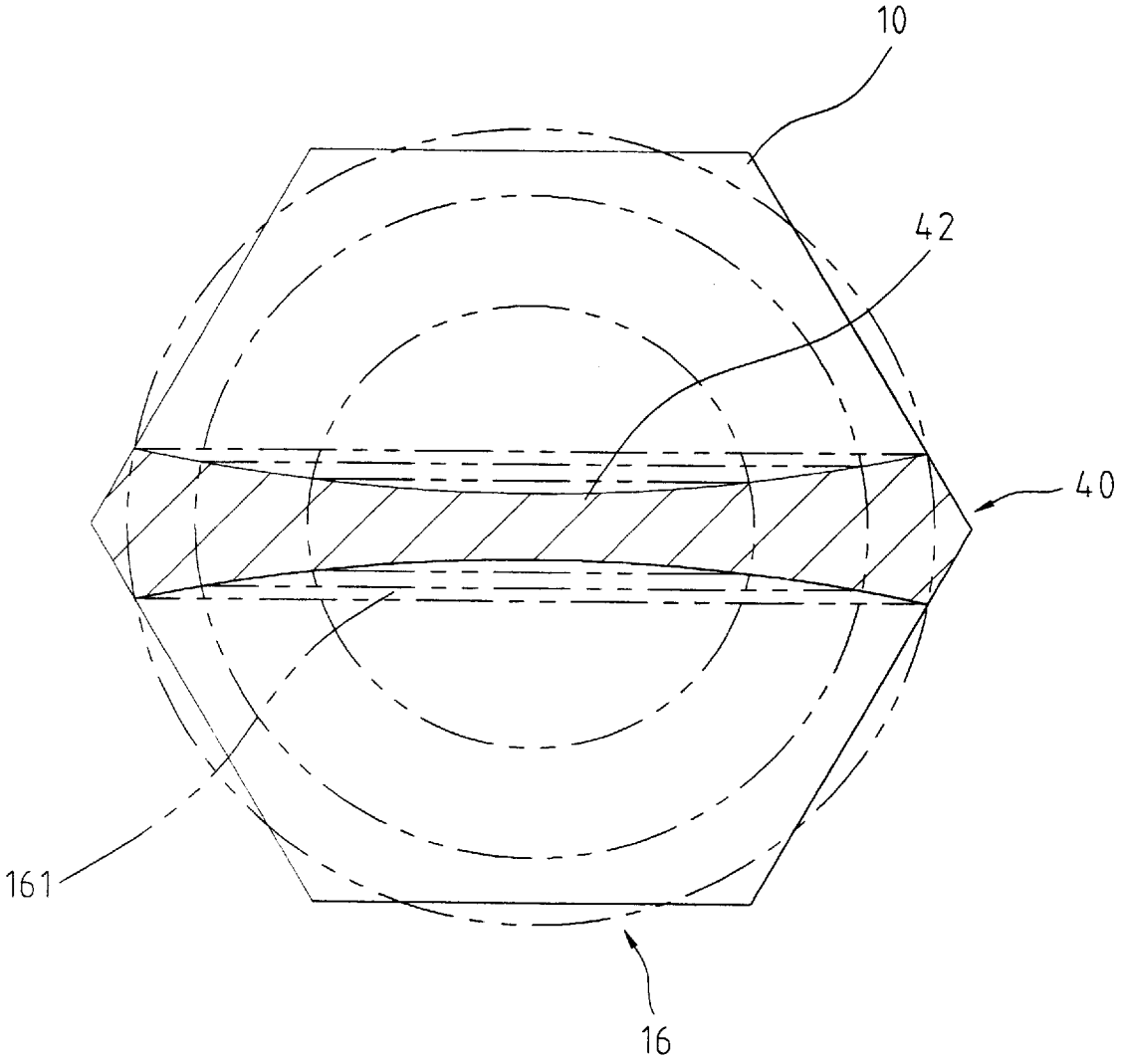
FIG. 8 is a top view illustrating use of the cabinet tip on fasteners of different slot sizes.
Figure 9:
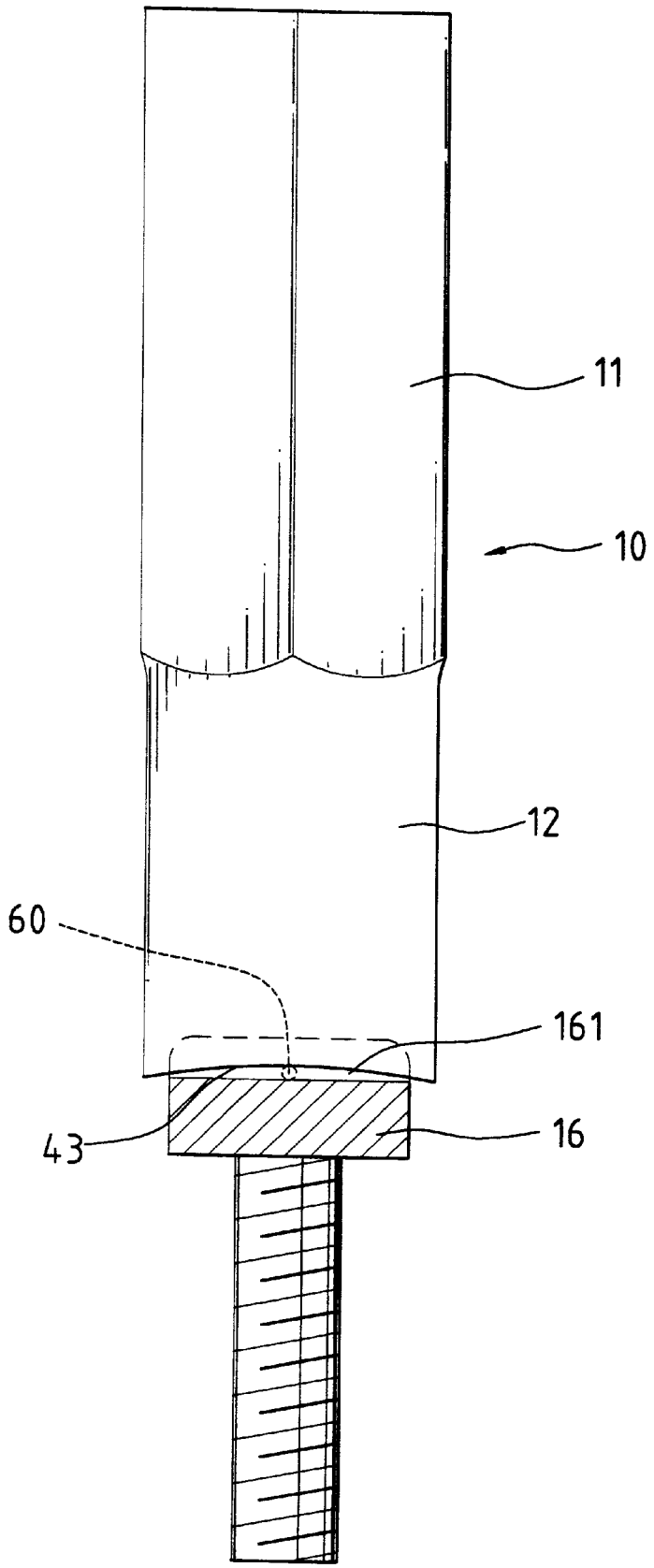
FIG. 9 is a schematic side view of the cabinet tip engaged in a fastener slot having an alien object therein.
Figure 10:
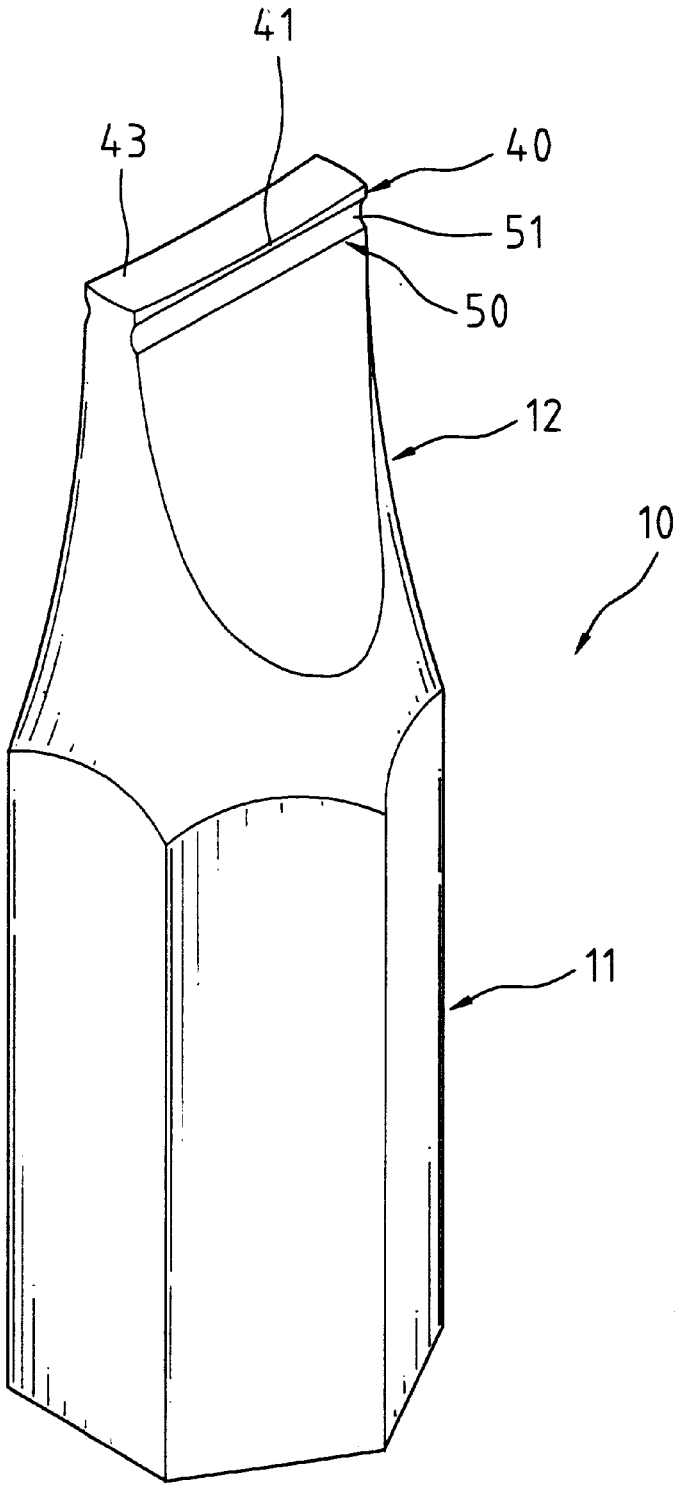
FIG. 10 is a perspective view of a modified embodiment of the cabinet tip of a screwdriver in accordance with the present invention.

FIG. 7 illustrates a modified embodiment of the cabinet tip 12, wherein at least one of two lateral sides 42 of the top face 43 is modified to be concave (see FIG. 8). In addition, the top face 43 of the drive tip end 40 includes an arcuate recess (not labeled, see FIG. 9). Referring to FIG. 8, the concave lateral sides 42 of the top face 43 allow the cabinet tip 12 to be engaged with fasteners of different slot sizes. Referring to FIG. 9, when the slot 161 of the fastener 16 has a small particle 60 therein, the small particle 60 can be accommodated in the arcuate recess in the top face of the drive tip end 40. This is because any two points of the bottom wall of the arcuate recess may provide a stable support for the drive tip end 40. A larger particle in the slot 161 that may damage the top face of the drive tip end 40 can be easily found and cleared. Thus, the cabinet tip of this embodiment is capable of driving fasteners of different slot sizes, which is very convenient and useful. FIG. 10 illustrates a modified embodiment of the screwdriver 10, wherein the drive tip end 40 includes a concave top face 43 and two flat surfaces 41.

Although the invention has been explained in relation to its preferred embodiment, it is to be understood that many other possible modifications and variations can be made without departing from the spirit and scope of the invention as hereinafter claimed.

What is claimed is:

1. A cabinet tip for a screwdriver, comprising a drive tip end and a neck area adjacent the drive tip end, the neck area including a bottom wall adapted to engage with a side wall defining a slot of a fastener to be driven when the cabinet tip is in an inclined status relative to the fastener, wherein the the drive tip end includes two arcuate lateral surfaces, wherein the neck area includes two opposite arcuate grooves each defined below an associated said arcuate lateral side.

2. The cabinet tip for a screwdriver as claimed in claim 1, wherein the drive tip end includes an arcuate top face.

3. A cabinet tip for a screwdriver, comprising a drive tip end having two flat lateral surfaces, the drive tip end further including an arcuate groove defined adjacent each said flat lateral surface, each said arcuate groove including a bottom wall adapted to be engaged with a side wall defining a slot of a fastener to be driven when the cabinet tip is in an inclined status relative to the fastener, the drive tip end further including an arcuate top face.

* * * * *